United States Patent [19]

Josemans

[11] 4,324,957

[45] Apr. 13, 1982

[54] SLIDE SWITCH

[75] Inventor: Leo J. M. Josemans, Farmville, Va.

[73] Assignee: Stackpole Components Company, Raleigh, N.C.

[21] Appl. No.: 178,771

[22] Filed: Aug. 18, 1980

[51] Int. Cl.[3] ..... H01H 15/00

[52] U.S. Cl. ..... 200/16 C; 200/291

[58] Field of Search ..... 200/11 J, 11 K, 16 R, 200/16 B, 16 C, 16 D, 16 F, 68, 69, 76–78, 243, 248, 249–251, 258–261, 290, 291, 340

[56] References Cited

U.S. PATENT DOCUMENTS

| | | | |
|---|---|---|---|
| 3,217,112 | 11/1965 | Campbell et al. | 200/16 C |
| 3,427,415 | 2/1969 | Avner | 200/16 C X |
| 3,643,046 | 2/1972 | Zdanys, Jr. et al. | 200/16 D X |
| 3,940,585 | 2/1976 | Schaad | 200/16 C X |
| 3,963,884 | 6/1976 | Pollock | 200/16 D |
| 4,091,247 | 5/1978 | Gaber | 200/340 X |
| 4,218,601 | 8/1980 | Saito | 200/340 X |
| 4,251,697 | 2/1981 | Gonzalez | 200/340 X |

*Primary Examiner*—James R. Scott

*Attorney, Agent, or Firm*—Brown, Flick & Peckham

[57] ABSTRACT

An actuating member in an electric switch housing is provided with a bore that opens downwardly inside the housing and contains a plunger slidably mounted therein and projecting from the lower end of the bore. A coil spring in the bore presses the plunger down against a movable contact to press it against stationary contacts. The plunger and movable contact are interconnected for movement of the contact by the actuating member, and the actuating member and plunger are provided with interengaging means for limiting downward movement of the plunger in the bore in the absence of the movable contact, whereby the plunger cannot escape from the actuating member.

6 Claims, 4 Drawing Figures

SLIDE SWITCH

Slide switches are well known, in which a slide is movable back and forth in a housing to move a movable contact into bridging engagement with a pair of fixed contacts, against which the bridging contact is pressed by a spring carried by a slide.

OBJECTS OF THE INVENTION

It is among the objects of this invention to provide an inexpensive slide switch, in which the only exposed metal parts are the terminals, in which the movable contact is pressed against fixed contacts by means of a spring-pressed plunger, and in which the spring and plunger are held captive in the slide.

BRIEF DESCRIPTION OF THE DRAWINGS

The preferred embodiment of the invention is illustrated in the accompany drawings, in which.

DESCRIPTION OF THE INVENTION

Figure 4:
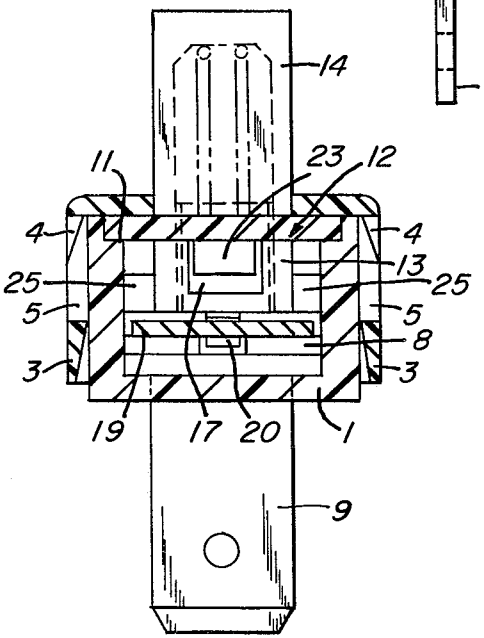
FIG. 4 is a vertical section taken on the line IV—IV of FIG. 3.
Figure 1:
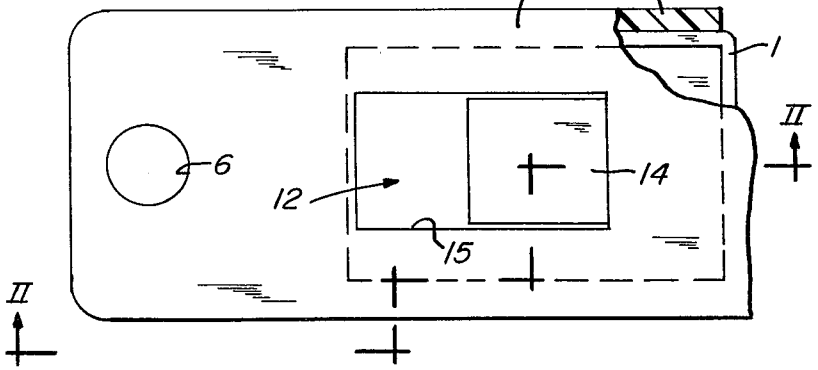
FIG. 1 is a plan view, partly broken away.

Referring to the drawings, the switch housing is formed from a rectangular case 1 that has an open top and a cover 2 for the top of the case. These two members are made of insulating material, such as a plastic. The cover is a snap-on cover that has a flat top and downwardly extending side flanges 3. Each side flange is provided with a rectangular opening 4, into which a retaining boss 5 molded on the adjoining side of the case projects. The bosses are inclined downwardly and outwardly as shown in FIG. 4 so that in applying the cover to the case the lower edges of the side flanges sliding down the bosses spring the flanges further apart until the lower walls of openings 4 reach the bottom of the bosses, whereupon the flanges snap in against the sides of the case. The flat top of the cover extends beyond the ends of the case and is provided near its opposite ends with openings 6 for suitable fasteners to secure the switch in place.

Figure 2:
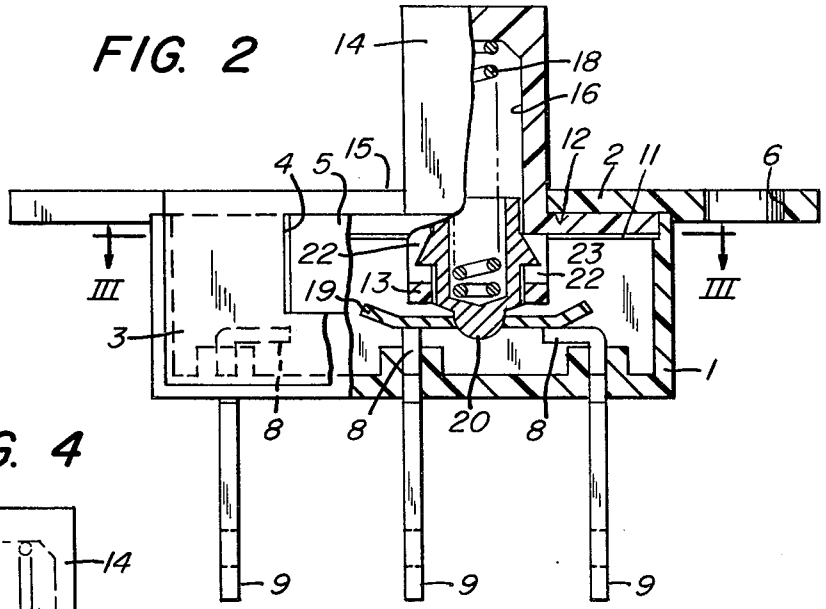
FIG. 2 is a side view and cross section taken on the line II—II of FIG. 1.

Inside the switch housing, as shown in FIG. 2, there are at least two stationary electric contacts 8 spaced lengthwise of the housing near its bottom. These contacts are the upper ends of electric terminals 9 that extend down through the bottom of the case. Where three contacts are used, the central one is located midway between the other two.

Figure 3:
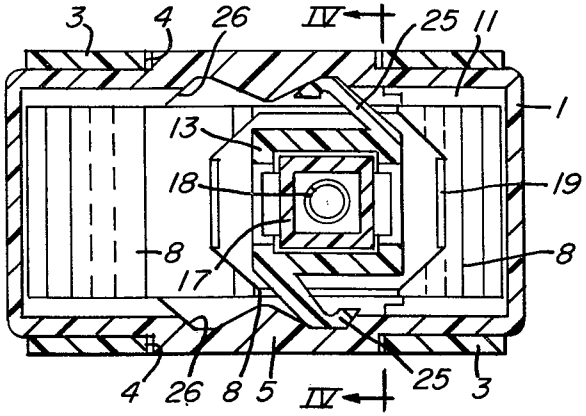
FIG. 3 is a horizontal section taken on the line III—III of FIG. 2.

Slidably mounted inside the switch housing on ledges 11 formed near the top of the case is a slide 12 that engages the lower surface of the cover. As shown in FIGS. 3 and 4, this slide, which is made of an insulating material, such as a plastic, has a downwardly extending rectangular central portion 13 directly below and actuating knob 14 that extends up through a longitudinal slot 15 in the cover. It is a feature of this invention that the downwardly extending central portion 13 on the knob are provided with a downwardly opening bore 16 in the lower portion of which a plunger 17 is slidably mounted for vertical movement. The plunger is made of a plastic and is hollow with an open top, and a coil spring 18 inside the plunger extends above it and presses against the upper wall of the bore. This spring presses the plunger downwardly into engagement with a movable electric contact 19, the central portion of which is provided with a rectangular hole for receiving a projection 20 integral with the lower end of the plunger. The spring-pressed plunger presses the movable contact down against two underlying stationary contacts 8 when the slide is at one end of the hosing, whereby to bridge the two fixed contacts. When the slide is moved lengthwise of the housing, the projection 20 on the plunger moves the movable or bridging contact along with it. This contact has a flat top and upwardly inclined ends. The central stationary contact is provided with a notch so that the plunger projection can pass the contact when the slide is moved from one end of the housing to the other.

Another feature of this invention is that the plunger is confined in the slide so that the slide and plunger and coil spring will stay assembled while they are being placed in the switch housing or removed from it. Once in the housing, the movable contact would limit downward movement of the plunger. In order to lock the plunger in the slide, two opposite sides of the downwardly extending central portion of the slide are provided with recesses, preferably in the form of holes 22 through the side walls of bore 16. Projecting into these holes are lateral projections 23 on opposite sides of the plunger. These projections are spaced from the ends of the plunger and extend vertically a lesser distance than the holes 22 that receive them, whereby the projections can move up and down in the holes. The lower ends of projections 23 are more or less perpendicular to the sides of the plunger, and the projections have inclined surfaces that extend from their lower ends upwardly and inwardly to the plunger side walls.

In order to assemble the plunger with the slide, the coil spring is set in the plunger and then the spring and the upper end of the plunger are inserted in the lower end of bore 16. The plunger is then pushed upwardly, which causes the inclined surfaces of its projections 23 to flex the recessed walls of the slide outwardly sufficiently to permit the projections to enter the bore. As soon as the lower ends of the projections pass the bottoms of holes 22, the walls of the bore snap back and the plunger is trapped in the slide.

To hold the slide at at least one end of the housing, the opposite sides of the case are provided with indexing notches 25 that receive the outer ends of a pair of indexing prongs 26 integral with the adjacent sides of the central portion 13 of the slide, as shown in FIG. 3. These prongs are inclined lengthwise of the case so that their outer ends can be flexed toward each other when sufficient pressure is applied to the knob to move the prongs out of the notches that have slanting sides. Preferably, there are two indexing notches in each side of the case for a two-position switch so that the slide will be held by the indexing prongs when at either end of the housing. For a three position switch, there would be three notches in each side of the case. Although both indexing prongs may extend toward the same end of the case, it is preferred that they extend in opposite directions as shown to provide equalization of the operating force required for either direction of travel of the slide.

Advantages of the Invention

A slide switch made in accordance with this disclosure has the advantage that the slide, spring and plunger form a permanently connected sub-assembly that can be handled as a unit in assembling the switch. This facilitates making the switch.

According to the provisions of the patent statues, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. An electric switch comprising a housing having a top provided with a slot, an actuating member extending through said slot and provided with a bore opening downwardly inside the housing, a plunger slidably mounted in said bore and projecting from its lower end, a movable contact in the housing beneath said plunger, stationary contacts in the housing below said movable contact and engageable thereby, and a coil spring in said bore pressing the plunger down against the movable contact, the plunger and movable contact being interconnected for movement of the contact by said actuating member, the actuating member and plunger being provided with interengaging means for limiting downward movement of the plunger in said bore in the absence of said movable contact, whereby the plunger cannot escape from the actuating member.

2. A switch according to claim 1, in which the lower end of the plunger is provided with a projection, and said movable contact is provided with a hole receiving said projection to interconnect the plunger and contact.

3. A switch according to claim 1, in which the wall of said bore around said plunger is provided with recesses, and the plunger is provided with lateral projections extending into said recesses and movable therein lengthwise of said bore, said recesses and lateral projections forming said interengaging means.

4. A switch according to claim 3, in which the recessed wall of the bore is resilient enough to be flexed outwardly by said lateral projections when the plunger is forced upwardly in said bore until the projections spring out into said recesses.

5. A switch according to claim 2, in which there are three of said stationary contacts spaced lengthwise of said housing, and the upper end of the middle stationary contact is provided with a central notch for passage of said plunger projection when the movable contact is slid across the middle contact.

6. A switch according to claim 5, in which the wall of said bore around said plunger is provided with recesses, and the plunger is provided with lateral projections extending into said recesses and movable therein lengthwise of said bore, said recesses and lateral projections forming said interengaging means.

* * * * *